US006720724B2

(12) United States Patent
Chonan et al.

(10) Patent No.: US 6,720,724 B2
(45) Date of Patent: Apr. 13, 2004

(54) DEFLECTION YOKE APPARATUS

(75) Inventors: Yusuke Chonan, Oyama (JP); Keiji Morimoto, Oyama (JP)

(73) Assignee: Victor Company of Japan, Ltd., Kanagawa (JP)

( * ) Notice: Subject to any disclaimer, the term of this patent is extended or adjusted under 35 U.S.C. 154(b) by 204 days.

(21) Appl. No.: 09/841,124

(22) Filed: Apr. 25, 2001

(65) Prior Publication Data

US 2002/0011773 A1 Jan. 31, 2002

(30) Foreign Application Priority Data

Apr. 25, 2000 (JP) ..... 2000-124086

(51) Int. Cl.[7] ..... H01J 29/70; H01J 1/24; H01J 19/18

(52) U.S. Cl. ..... 313/440

(58) Field of Search ..... 313/440

*Primary Examiner*—Sumati Krishnan
(74) *Attorney, Agent, or Firm*—Connolly, Bove, Lodge & Hutz LLP

(57) ABSTRACT

A neck portion (3) formed in the subterminal portion of the narrower diameter side of the funnel shaped separator, has holding portions (32*a*, 32*b*) and upper holding portion (33*a*, 33*b*) to hold magnetic rings (10, 11, 20, 21). The protrusions (80*a*, 80*b*) formed in the neck portion (3) have slope side (80*a*1, 80*b*1). Upon the insertion of the magnetic rings (10, 11, 20, 21) to the neck portion (3) from the narrower diameter side thereof, the magnetic rings (10, 11, 20, 21) contact the slope sides (80*a*1, 80*b*1) before they contact the slope sides (33*a*2, 33*b*2) of the protrusions (33*a*0, 33*b*0) of the upper holding portion (33*a*, 33*b*).

2 Claims, 9 Drawing Sheets

DEFLECTION YOKE APPARATUS

BACKGROUND OF THE INVENTION

1. Field of the Invention

The present invention relates to a deflection yoke used with an in-line type cathode ray tube (CRT), and particularly relates to a deflection yoke for adjusting a characteristic of a magnetic field, such as convergence or purity, by rotating a multipolar magnetic ring mounted on a cylindrical neck portion of such deflection yoke.

2. Description of the Related Art

Generally, a deflection yoke used with an in-line type CRT, has a multipolar, for example, dipole or quadrupole magnetic ring. The multipolar magnetic ring is used for adjustment of a magnetic field characteristic such as convergence or purity of a CRT by tuning a position of such the multipolar magnetic ring.

FIG. 8 is a perspective view for explaining an example of a deflection yoke for a CRT. In FIG. 8, the deflection yoke comprises a pair of separators 1*a* and 1*b* made by an insulating material, a pair of horizontal deflection coils (not shown) in inside of the deflection yoke, a pair of vertical deflection coils 7 on the outside of the deflection yoke, and a pair of cores 2 on the outer side of the vertical deflection coil 7. A flange if is formed in a narrower diameter side of the first separator 1*a* and the second separator 1*b*, and a cylindrical neck portion 103 is formed in the flange 1*f*. A clamp band 5 with a screw 6 is loaded on the upper portion of the neck portion 103 to stabilize deflection yoke on to CRT.

FIG. 9 is a partial perspective view for explaining the example of the deflection yoke shown in FIG. 8. In FIG. 9, the cylindrical neck portion 103 having tongues 103*a* through 103*f*, is formed on a flange 1*f* with the first and second separators 1*a* and 1*b*.

The cylindrical neck portion 103 is inwardly flexible as it has slits 104*a* through 104*f*. A clamp band 5 for fixing the deflection yoke to a neck of the CRT is provided on the upper side of the neck portion 103. The screw 6 is screwed to the clamp band 5, and fastens the deflection yoke to the neck of the CRT by tightening the clamp band 5 about the neck portion 103. A prominence 14 is formed on the upper portion of tongues 103*c* and 103*f* to fit with a pair of hole 5*a* and 5*b* formed in the clamp band 5. The prominence 14 has a slope in downward direction for leading the holes 5*a* and 5*b* to make the clamp band 5 easily fit with the neck portion 103. The clamp band 5 with a screw 6 is loaded on the upper portion of the neck portion 103 to stabilize the deflection yoke on to the CRT.

A magnetic ring 10 and a magnetic ring 11 having a multipolar magnet respectively are provided between the clamp band 5 and the flange 1*f* of the first and second separators 1*a* and 1*b*. FIG. 9 shows the clamp band 5 and the magnetic rings 10 and 11 being removed from the neck portion 103. Generally, the magnetic rings 10 and 11 comprise material dispersed with magnetic powder such as barium ferrite or the Alnico alloy substance evenly on a nylon plastic. As the magnetic ring has variety in size at manufacturing, the inner diameter of the magnetic rings 10 and 11 is 0.4 mm wider at maximum than the outer diameter of the neck portion 103, in order to avoid the magnetic ring being tightfitting with the neck portion 103.

More precisely, protrusions 12*a* and 12*b* are provided at the bottom of the neck portion 103, and are flexible in the longitudinal direction of the neck of the CRT (i.e. the direction of a Z axis). A hook 13 having a claw 13*a* of triangular shape at their distal ends are formed in the tongues 103*c* and 103*f* of the neck portion 103. The magnetic rings 10 and 11 are inserted from the rear side of the deflection yoke, about the neck portion 103 between the protrusions 12*a* and 12*b*, and the claw 13*a*.

FIG. 10 is a cross-sectional view of the neck portion 103 along with the direction of the Z axis. An edge side 13*a*1 of the claw 13*a* is almost orthogonal with the Z axis and a sloped side 13*a*2 of the claw 13*a* stick out with length d1 which is about 1.3 mm long enough to hold the magnetic ring being attached between the protrusions 12*a* and 12*b*, and the claw 13*a*. An outer side 13*a*3 of the claw 13*a* is provided to maintain the strength of metal mold for molding the separators 1*a* and 1*b*. The outer side 13*a*3 is almost parallel to the Z axis and has length of approximately 0.3 mm.

Recently, there has been a need for small display monitor using CRT in the market. In order to provide such a small display, the length of CRT and the deflection yoke is required to be shorter. For this reason, the distance between the bottom side of the clamp band 5 and the bottom side of magnetic rings attached to the neck portion 103 is required to be shorter, and the length of the claw 13*a* in the direction of Z axis is required to be 1.3 mm at maximum. Under circumstance, the length of each side of the claw 13*a* should be set to make slope angle θ of the slope side 13*a*2 bigger so that the magnetic rings can be easily attached to the neck portion 103.

A slope side 13*a*2*s* is a start position of the slope for the slope side 13*a*2. The slope side 13*a*2*s* is not set to the position coming out of the outer diameter side of the neck portion 103 but contiguous the outer diameter portion of the neck portion 103. The slope angle θ, for example, is 32 degrees. The reason why the slope side 13*a*2*s* does not start from the inner diameter side of the neck portion 103 (and the reason why the claw 13*a* has the edge side 13*a*1) is because the slope angle θ will be maximum at this position.

As the magnetic rings 10 and 11 are inserted to the neck portion 103 from the narrower diameter side of the deflection yoke, the magnetic rings 10 and 11 contact the prominence 14 and the neck portion 103 flex inwardly to let the magnetic rings 10 and 11 pass through the prominence 14. Then the magnetic rings 10 and 11 contact the slope side 13*a*2 and the tongue 13 flex inwardly. Eventually, the magnetic rings 10 and 11 are held between the protrusions 12*a* and 12*b*, and the claw 13*a*. The distance between the protrusions 12*a* and 12*b*, and the claw 13*a* is lesser than the thickness of the magnetic rings 10 and 11 so that the bounce force of the protrusion 12*a* and 12*b* holds the magnetic rings 10 and 11.

The adjustment of a characteristic of a magnetic field of CRT can be accomplished by putting a deflection yoke on the CRT and rotating the magnetic rings 10 and 11. The magnetic rings can be rotate at an appropriate torque (not too tight or not too loose) by the protrusions 12*a* and 12*b*, and the claw 13*a* holding the magnetic rings 10 and 11 so that the magnetic rings 10 and 11 can not easily rotate before they are being fixed with a glue after the adjustment. This torque is also caused by the bounce force of the protrusions 12*a* and 12*b* in the direction of the Z axis.

FIG. 11 is a cross-sectional view of the tongues 103*f* and 103*c* of the neck portion 103 along with the direction of the Z axis where the magnetic ring 11 is being inserted. When the magnetic rings 10 and 11 is inserted in the neck portion 103 by hands, the magnetic ring 11 will occasionally be pushed to the direction shown as an arrow A in FIG. 11 which is the direction orthogonal to the Z axis. Then the tongue 103*f* flexes inwardly from the position shown in a dotted line. At this position, the inner circumference side of the magnetic ring 11 contacts the edge side 13*a*1 of the claw 13*a*.

This will cause the insertion of magnetic ring 11 to the neck portion 103 difficult. Too much strength to insert the magnetic ring 11 in the neck portion 103 at this position may break the magnetic rings 10 and 11. As explained above, the magnetic rings 10 and 11 may break in the way of inserting.

SUMMARY OF THE INVENTION

Accordingly, in consideration of the above-mentioned problem of the related art, an object of the present invention is to provide a deflection yoke of which a magnetic ring is attached to the neck portion, to control convergence by tuning such magnetic ring, and which can prevent a magnetic ring from being disengaged from a neck portion without losing smooth attachment to the neck portion.

In order to achieve the above object, the present invention provides, according to an aspect thereof, a deflection yoke apparatus including neck portion (3) in a cylindrical shape formed on a subterminal portion of a funnel shaped separator having a narrower diameter portion and a wider diameter portion, a magnetic ring (10, 11, 20 and 21) rotatably mounted on the neck portion (3), a holding portion (33*a*, 33*b*) for holding the magnetic ring from the narrower diameter portion side; and a protrusion (80*a*, 80*b*, 81) formed on the neck portion having a first slope surface (80*a*1, 80*b*1) decline to the outer direction from the narrower diameter portion side to the wider diameter portion side of the neck portion, wherein the magnetic ring contacts the first slope surface before contacting the holding portion when the magnetic ring is inserted to the neck portion from the narrower diameter portion side, and the protrusion leads the magnetic ring to the holding portion.

Other objects and further features of the present invention provides the deflection yoke as mentioned above, wherein the holding portion (33*a*, 33*b*) has a second slope surface (33*a*0, 33*b*0) decline to the outer direction from the narrower diameter portion side to the wider diameter portion side of the neck portion (3), and the first slope surface (80*a*1, 80*b*1) of the protrusion leads the magnetic ring to the second slope surface of the holding portion.

Other objects and further features of the present invention provides the deflection yoke including neck portion (3) having a cylindrical shape and formed on a subterminal portion of a funnel shaped separator with a narrower diameter portion and a wider diameter portion, first protrusion (14) formed on the neck portion, clamp band (5) having a hole to fit with the first protrusion, for being attached to and for tightening up the neck portion, magnetic ring rotatably mounted on the wider diameter portion side of the neck portion than the position of the clamp band being attached to the neck portion, holding portion (33*a*, 33*b*) for holding the magnetic ring from the narrower portion side; and second protrusion (80*a*, 80*b*, 81) having a slope surface decline to the outer direction from the narrower diameter portion side to the wider diameter portion side of the neck portion, and formed on the neck portion between the first protrusion and the holding portion, wherein the magnetic ring being inserted to the neck portion contacts the slope surface before contacting the holding portion.

A deflection yoke incorporating the principles of the present invention will be described in detail with reference to the accompanying drawings, in which the same reference numerals and symbols are used to denote like or equivalent elements used in the aforementioned prior art deflection yoke, and the detailed explanation of such elements are omitted for simplicity.

DETAILED DESCRIPTION OF THE PREFERRED EMBODIMENTS

[First Embodiment]

Figure 1:
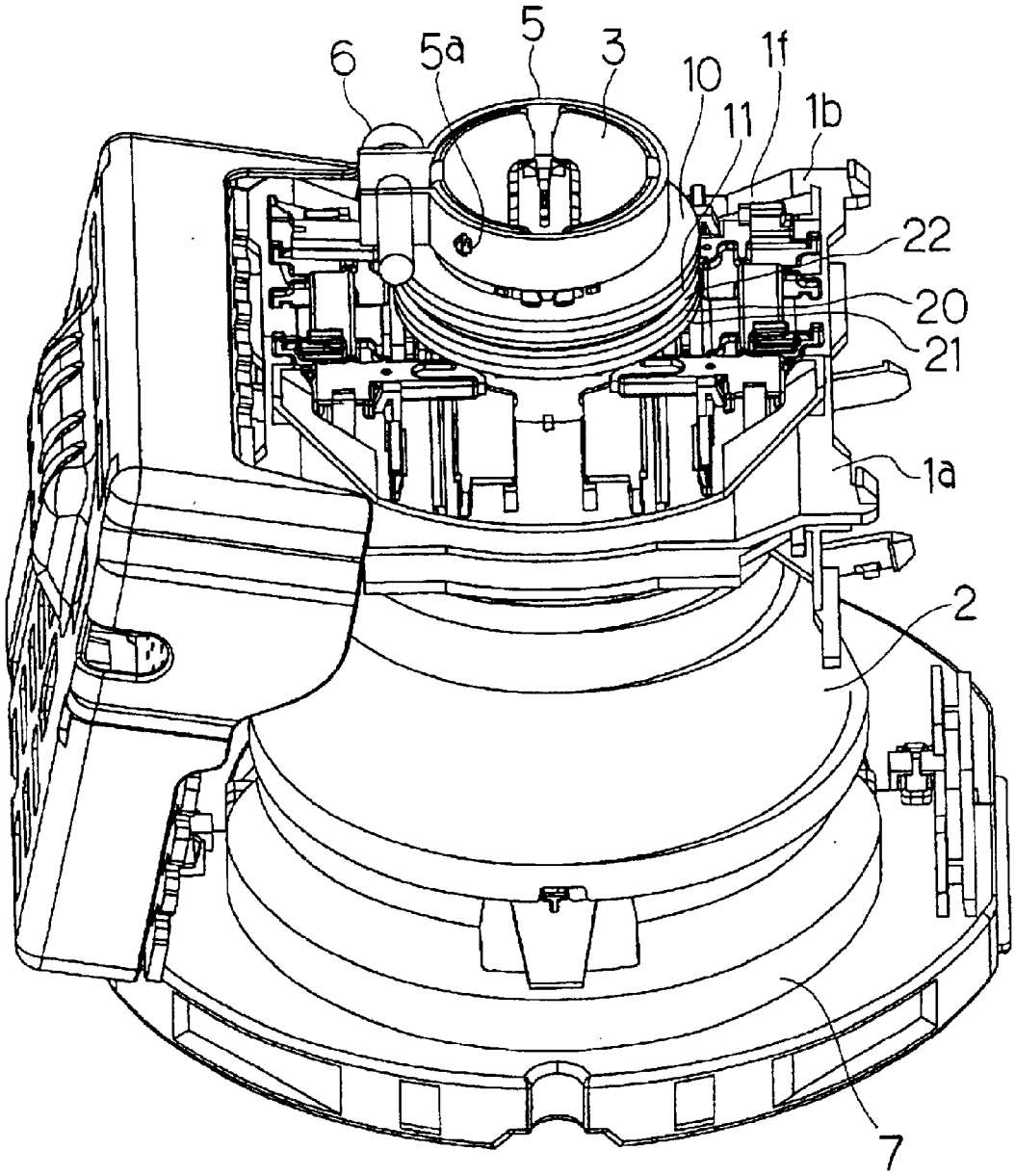
FIG. 1 is a perspective view of a deflection yoke according to a first embodiment of the present invention.

FIG. 1 is a perspective view of a deflection yoke according to the present invention. In FIG. 1, a deflection yoke for a CRT comprises a pair of separator 1*a* and 1*b* made by an insulating material to form an infundibular shape, a pair of horizontal deflection coils (not shown) in an inner side of the deflection yoke, a pair of vertical deflection coils 7 in outer side thereof, a pair of cores 2 in outer side of the vertical deflection coil 7, a flange If on a minor diameter side of the separators 1*a* and 1*b* with a cylindrical neck portion 3, forming on the flange 1*f*. There also provided a clamp band 5 on the neck portion 3, and the clamp band 5 comprises a hole 5*a* in its ring portion and a screw 6. The deflection yoke also comprises a pair of magnetic rings 10 and 11 and another pair of magnetic rings 20 and 21 to control the magnetic characteristic of the deflection yoke, and a spacer ring 22 between each pair of magnetic rings 10, 11 and 20, 21.

Figure 2:
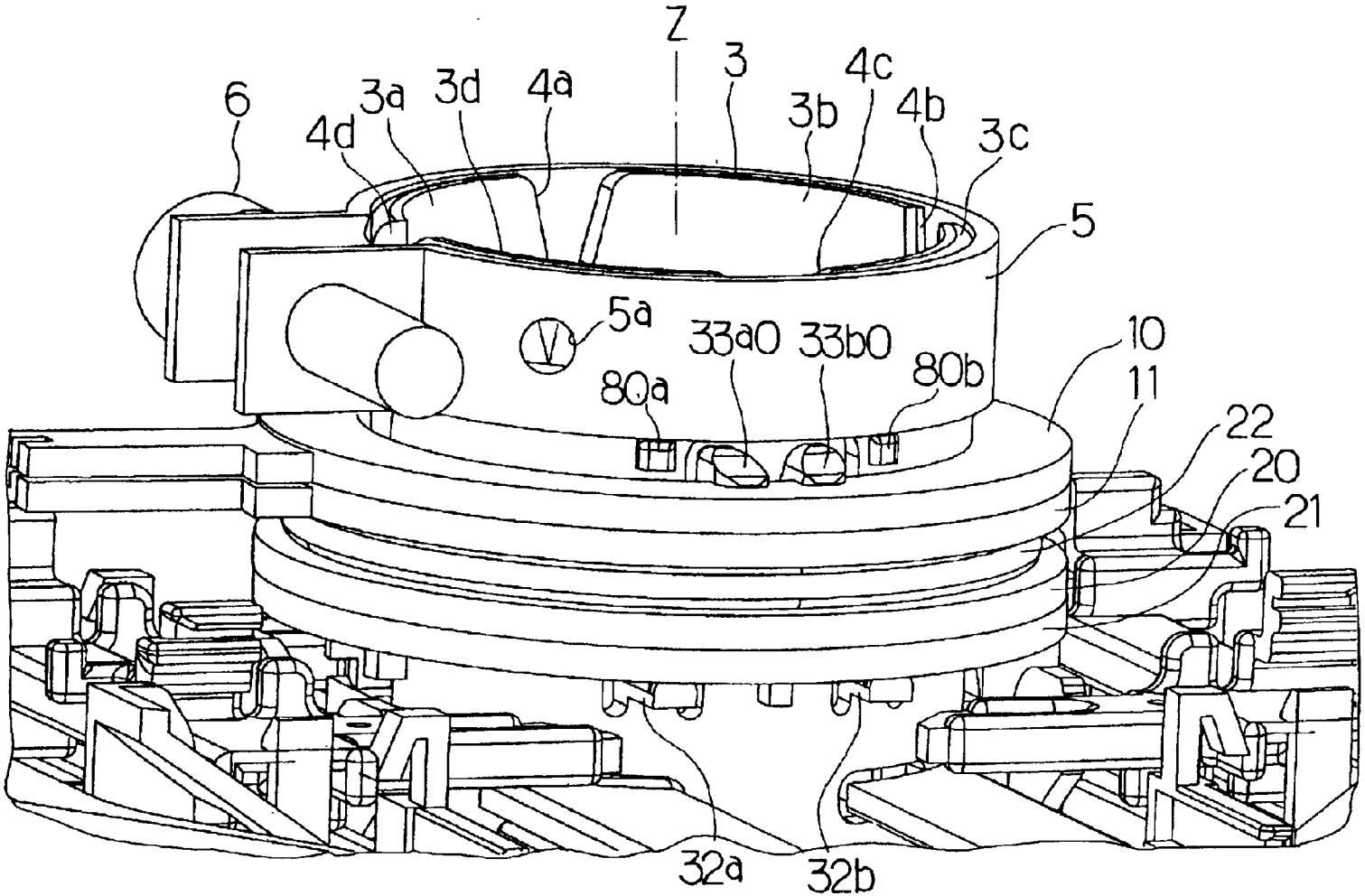
FIG. 2 is a partial perspective view of a deflection yoke shown in FIG. 1 according to the present invention.

FIG. 2 is a partial perspective view of the deflection yoke shown in FIG. 1 according to the present invention. The neck portion 3 has a cylindrical shape with tongues 3*a* through 3*d* and is formed on the flange 1*f* with a pair of separators 1*a* and 1*b*. The neck portion 3 is not limited to have four tongues that it may have six tongues as described in the prior art and more or less. The neck portion 3 is flexible inwardly by a plural of slits 4*a* through 4*d* formed on thereof. The clamp band 5 is attached to the neck portion 3 to stabilize the deflection yoke on a neck portion of a CRT.

The clamp band 5 has a hole 5*a* on its ring portion to fit with a prominence (not shown) formed on the side of neck portion 3. The screw 6 tighten an inner circumference of the clamp band 5 as it screws to stabilize the deflection yoke on the neck portion of the CRT.

The magnetic rings 10, 11, 20 and 21 are attached to the neck portion 3 between the clamp band 5 and flange if with separators 1*a* and 1*b*. The spacer ring 22 is inserted unrotatablly between each pair of magnetic rings 10, 11 and magnetic rings 20, 21 to make each pair of magnetic rings rotate independently. The magnetic rings 10, 11, 20 and 21 comprise of material dispersed with magnetic powder such as barium ferrite or the Alnico alloy substance evenly on a nylon plastic. There provided an upper holding portions 33*a*0 and 33*b*0, and holding portions 32*a* and 32*b* on the side of neck portion 3 to hold the magnetic rings 10, 11 and 20, 21, and there also provided a protrusion 80*a* and 80*b* between the clamp band 5 and magnetic rings 10 and 11. Z axis shown in FIG. 2 is identical to the coaxial axis of the CRT to which the neck portion 3 is attached.

Figure 3:
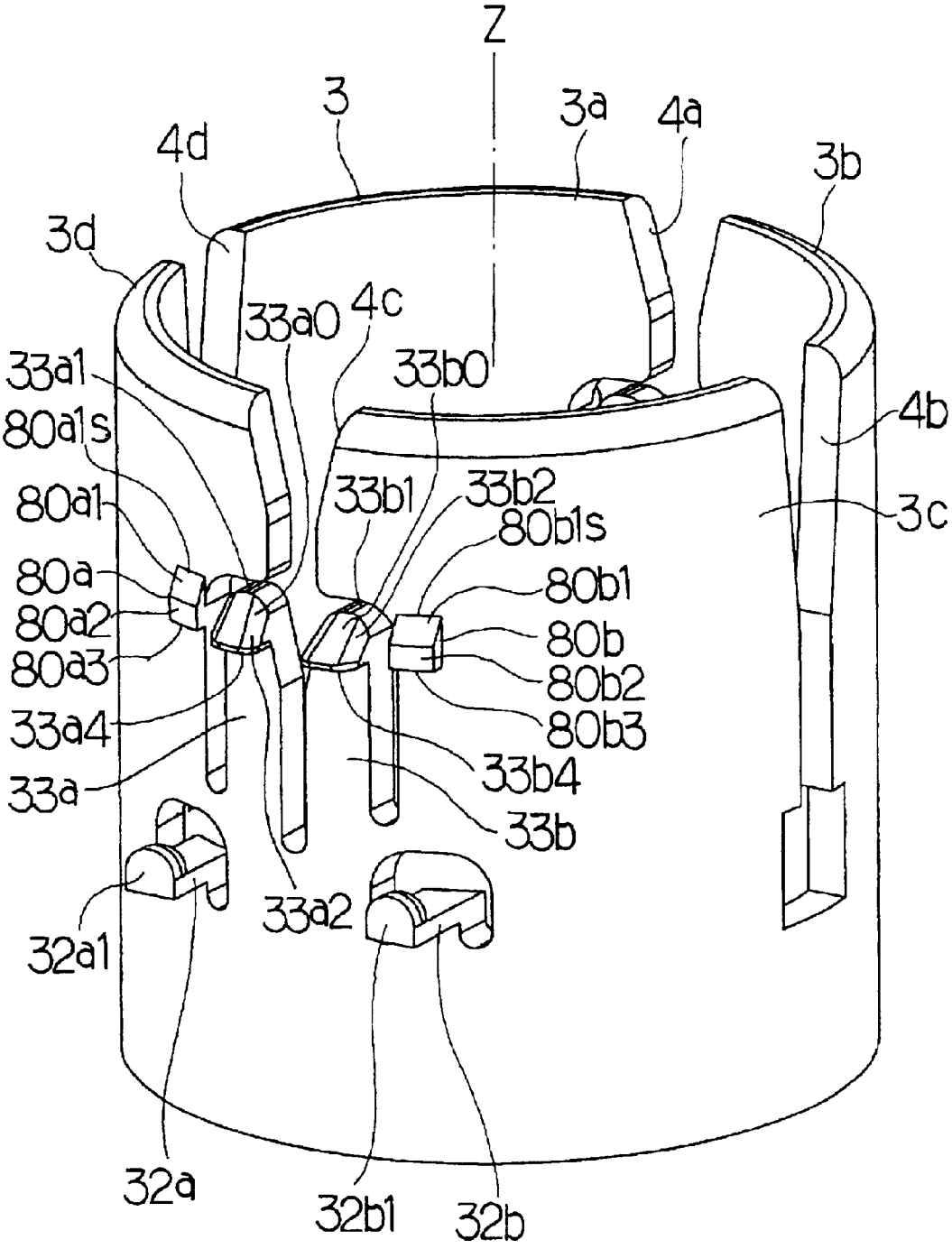
FIG. 3 is a partial perspective view of a substantial portion of a deflection yoke according to the first embodiment of the present invention.

FIG. 3 is a partial perspective view of a substantial portion of a deflection yoke according to the first embodiment of the present invention. There provided holding portions 32*a* and 32*b* in the bottom portion of the center of neck portion 3 with tongues 3*d* and 3*c*. The holding portions 32*a* and 32*b* are formed in arm shape and flexible to the direction parallel to the Z axis. The edge portion of holding portion 32*a* has a protrusion 32*a*1 and the edge portion 32*b* has a protrusion 32*b*1 in the upward direction. There also provided a holding portion similar to the holding portions 32*a* and 32*b* in the opposite side of the neck portion 3 with tongues 3*a* and 3*b*.

Figure 9:
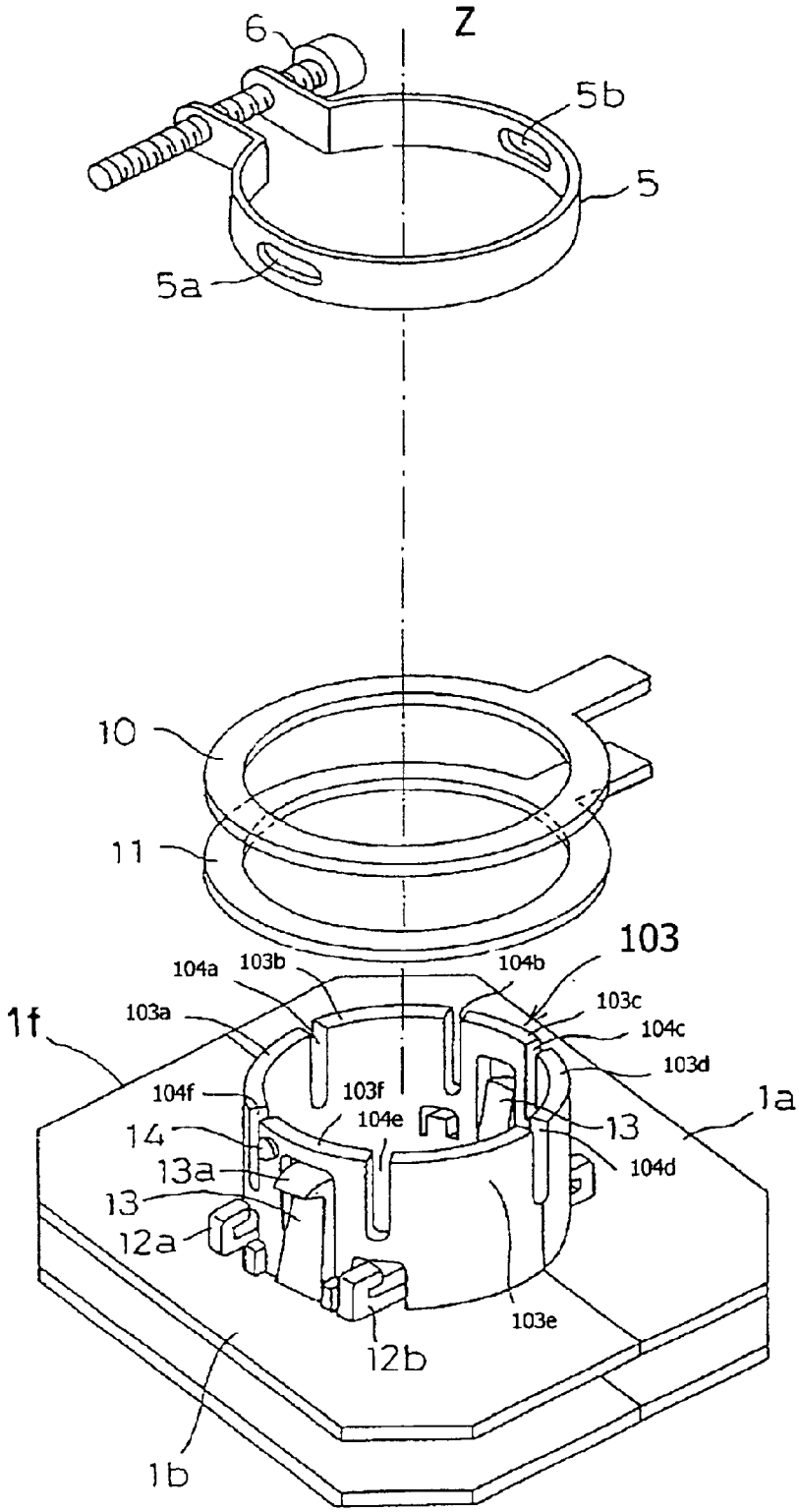
Fig. 9 Prior Art
FIG. 9 is a partial perspective view of a deflection yoke according to the prior art.

The neck portion 3 comprises L-shaped upper holding portions 33*a* and 33*b*. The upper holding portions 33*a* and 33*b* are connected with tongues 3*c* and 3*d*, and they are substantially independent portions. The upper holding portions 33*a* and 33*b* have substantially the same function of the tongue 13 shown in FIG. 9. The edge portion of each upper holding portion 33*a* and 33*b* has claw shaped protrusions 33*a*0 and 33*b*0. The protrusions 33*a*0 and 33*b*0 have edge surface 33*a*1 and 33*b*1 respectively, which surface is orthogonal with the Z axis. Slope surfaces 33*a*2 and 33*b*2 are the prominent surface of the upper holding portions 33*a* and 33*b* in outer side of the neck portion 3, and each surface 33*a*4 of the protrusion 33*a*0 and surface 34*b*4 of the protrusion 33*b*0 is opposed to the holding portions 32*a* and 32*b* respectively, each of which is orthogonal with the Z axis. The slope surfaces 33*a*2 and 33*b*2 have a downslope from the edge surface 33*a*1 and 33*b*1 towards the direction of holding portions 32*a* and 32*b*. More precisely, the slope surfaces 33*a*2 and 33*b*2 decline to the outer side towards the direction of the narrower diameter portion of the infundibular shaped deflection yoke to the wider diameter portion thereof.

The upper holding portions 33*a* and 33*b*, except for the protrusions 33*a*0 and 33*b*0, are placed in substantially the same circumference of the neck portion 3, There also provided an upper holding portion similar to the upper holding portion 33*a* and 33*b* on the opposite side of the tongues 3*d* and 3*c*. The upper holding portions 33*a* and 33*b*, and the holding portions 32*a* and 32*b* hold the magnetic rings 10, 11, 20 and 21.

In FIG. 3, there are provided protrusions 80*a* and 80*b* with rib shape on the tongues 3*c* and 3*d*. There is also provided a rib shaped protrusion similar to the protrusions 80*a* and 80*b* on each of the tongues 3*a* and 3*b*. The protrusions 80*a* and 80*b* are formed on positions lower (i.e. the wider diameter portion) than the upper position where the clamp band 5 is clamped to the neck portion 3, and contiguous to the protrusion 33*a*0 and 33*b*0.

Each protrusion 80*a* and 80*b* has a slope surface 80*a*1 and 80*b*1 of which slope starts from a position 80*a*1*s* and 80*b*1*s* respectively, and inclines to the outer side towards the direction of the holding portions 32*a* and 32*b*. Each slope surface 80*a*1 and 80*b*1 is connected with an outer surface 80*a*2 and 80*b*2 respectively, and side surfaces 80*a*3 and 80*b*3 are connected with the outer surfaces 80*a*2 and 80*b*2 respectively, in the position opposed to the holding portion 32*a* and 32*b*.

Figure 4:
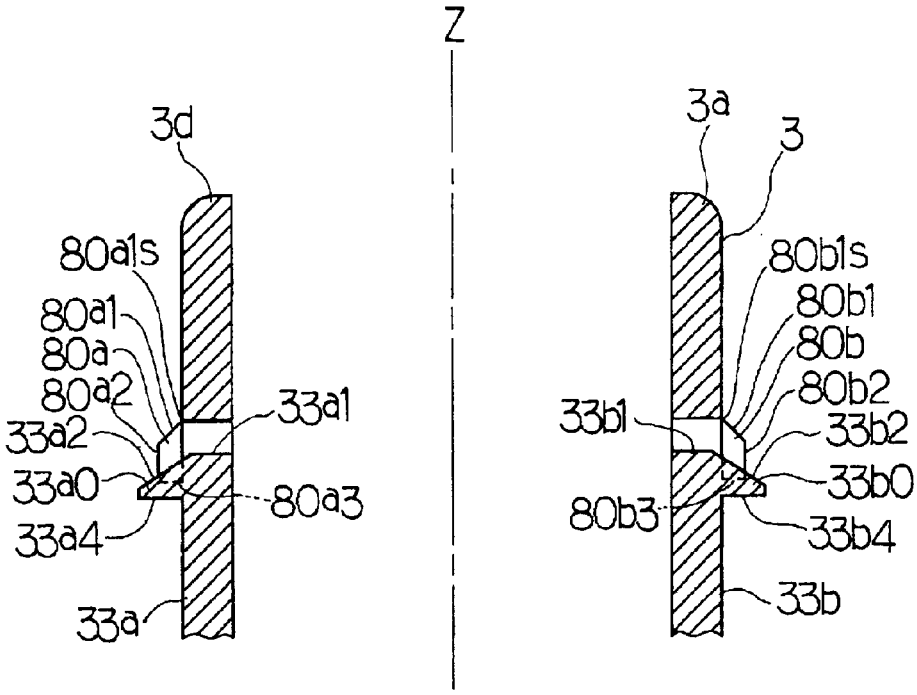
FIG. 4 is a cross-sectional view of a substantial portion of a deflection yoke shown in FIG. 3.

FIG. 4 is a cross-sectional view of the tongues 3*a* and 3*b* of the neck portion 3 towards the direction parallel to the Z axis. The protrusions 80*a* and 80*b* are formed above the protrusions 33*a*0 and 33*b*0 of the upper holding portions 33*a* and 33*b* as also shown in FIG. 3.

Figure 5:
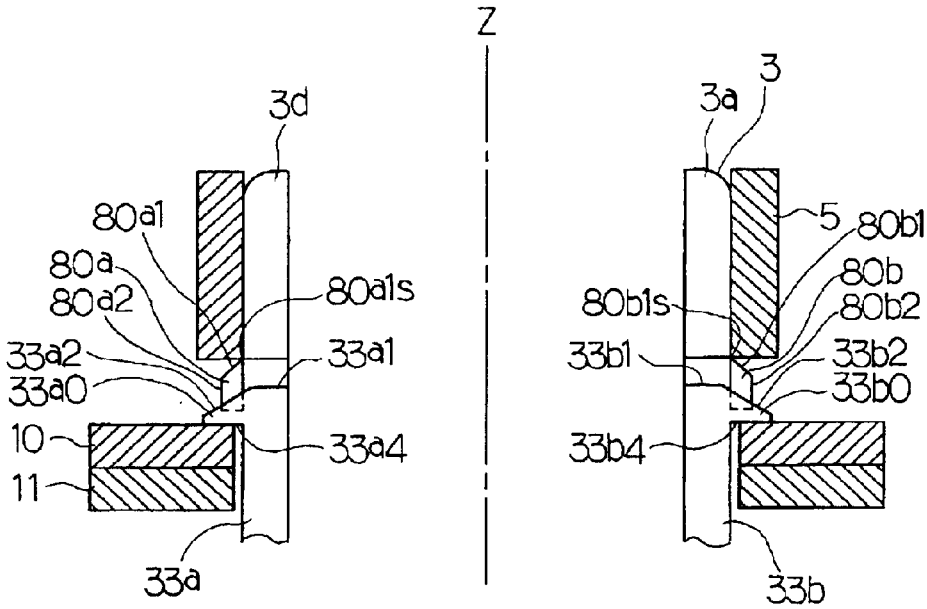
FIG. 5 is a cross-sectional view of a substantial portion of a deflection yoke for explaining a clamp band and a magnetic ring being inserted in a deflection yoke according to the present invention.

FIG. 5 is a cross-sectional view of the tongues 3*a* and 3*d* of the neck portion 3 shown in FIG. 4 where the clamp band 5 and the magnetic rings 10 and 11 are inserted on the neck portion 3. In FIG. 5, the bottom portion side of the clamp band 5 abuts edges 80*a*1*s* and 80*b*1*s* when the clamp band 5 is inserted in the neck portion 3. The slope 80*a*1 and 80*b*1 are formed in higher positions than the slope surfaces 33*a*2 and 33*b*2.

The protrusions 80*a* and 80*b* should be in a position where the slope surfaces 80*a*1 and 80*b*1 contact the magnetic rings 10 and 11 before they contact the slope surfaces 33*a*2 and 33*b*2 of the protrusions 33*a*0 and 33*b*0 when they are inserted in the neck portion.

The magnetic rings 10 and 11 should be held by the upper holding portions 32*a* and 32*b*, and the holding portions 33*a* and 33*b*. Accordingly, the side surfaces 80*a*3 and 80*b*3, and the surfaces 33*a*4 and 34*b*4 should be in the same surface orthogonal to the Z axis or the side surfaces 80*a*3 and 80*b*3 should be in the position nearer to the narrower diameter portion side of the deflection yoke than the surfaces 33*a*4 and 33*b*4.

The outer side surfaces 80*a*2 and 80*b*2 are formed in the same circumference and the outer side of protrusions 33*a*0 and 33*b*0 are formed in the same circumference. The diameter of circumference for the outer side surfaces 80*a*2 and 80*b*2 is shorter than the diameter of circumference for the outer side of protrusions 33*a*0 and 33*b*0. The diameter of circumference for the outer side surfaces 80*a*2 and 80*b*2 is bigger than the inner circumference of the magnetic rings 10, 11, 20 and 21.

Figure 6:
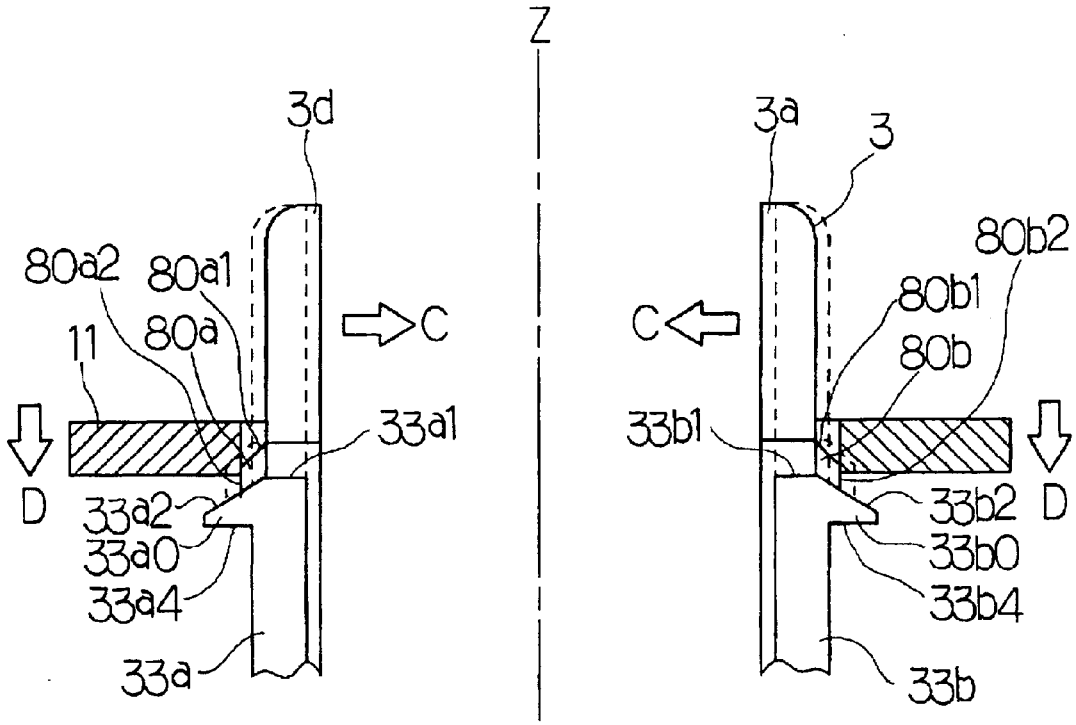
FIG. 6 is a cross-sectional view of a substantial portion of a deflection yoke for explaining an insertion of a magnetic ring to a deflection according to the present invention.

FIG. 6 is a cross-sectional view of a substantial portion of a deflection yoke for explaining an insertion of a magnetic ring to a deflection yoke according to the present invention. As the magnetic ring 11 is inserted to the neck portion 3, the magnetic ring 11 passes through the prominence 14 (not shown in FIG. 6) and comes to the position shown in FIG. 6. As the inner circumference of the magnetic ring 11 is shorter than the circumference of the outer side surfaces 80*a*2 and 80*b*2, the magnetic ring 11 contacts the slope surfaces 80*a*1 and 80*b*1. As the magnetic ring 11 moves to the direction D (shown as an arrow D), the tongues 3*c* and 3*d* (and tongues 3*a* and 3*b*) flex inwardly (to the direction shown as an arrow C) from the position shown in a dotted line to the position shown in a solid line. As the tongues 3*a* through 3*d* flex equally, the position of the magnetic ring 11 is set on the center of the neck portion 3. The insertion of the magnetic rings 10, 20 and 21 operates in exactly same manner.

As the magnetic ring 11 is inserted towards the direction D, the magnetic ring 11 contact the protrusions 80*a* and 80*b*, and then contact the slope sides 33*a*2 and 33*b*2. As the magnetic ring 11 is further inserted to the direction D, the holding portions 33*a* and 33*b* flex inwardly to the direction C, and it overcomes the protrusions 33*a*0 and 33*b*0. Consequently, the magnetic ring 11 is inserted between the protrusions 33*a*0 and 33*b*0 of the upper holding portions 33*a* and 33*b*, and the holding portions 32*a* and 32*b*.

The magnetic rings 10, 20 and 21 are inserted to the neck portion 3 as described above. As the pushing force is added to the neck portion 3 to the direction C, the bounce force pushes back the protrusions 80*a* and 80*b* to keep the center of magnetic rings 10, 11, 20 and 21 in the coaxial center of the neck portion 3. Further, the protrusions 80*a* and 80*b* induce the magnetic rings to contact the slope side 33*a*2 and 33*b*2 of the upper holding portions 33*a* and 33*b*.

Consequently, even when the tongues 3*a* through 3*d* flex, the magnetic rings 10, 11, 20 and 21 do not contact the edge surfaces 33*a*1 and 33*b*1 of the upper holding portions 33*a* and 33*b*, but contact the edge surfaces 33*a*4 and 33*b*4. This is a simple and easy way to attach the magnetic rings 10, 11, 20 and 21 on the neck portion 3. In addition, the magnetic rings 10, 11, 20 and 21 will not break since they do not contact the edge surfaces 33*a*1 and 33*b*1.

Further more, the protrusions 80*a* and 80*b* induce the clamp band 5 to the appropriate position and restrict the position towards the direction of the Z axis. Even if the clamp band 5 contact the slope surfaces 80*a*1 and 80*b*1 before tightening up the bolt 6, the clamp band 5 will slip the slope surfaces 80*a*1 and 80*b*1 to the direction towards the neck as the bolt 6 is being tightening up. Eventually, the clamp band 5 is induced to the position 80*a*1*s* and 80*b*1*s* as shown in FIG. 5.

Figure 10:
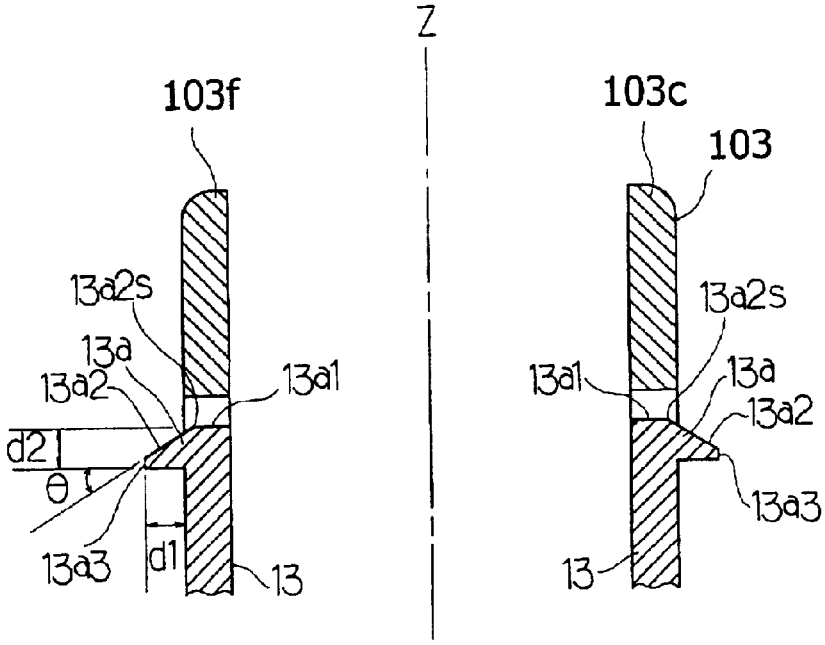
Fig. 10 Prior Art
FIG. 10 is a cross-sectional view of a deflection yoke for explaining the prior art.
Figure 11:
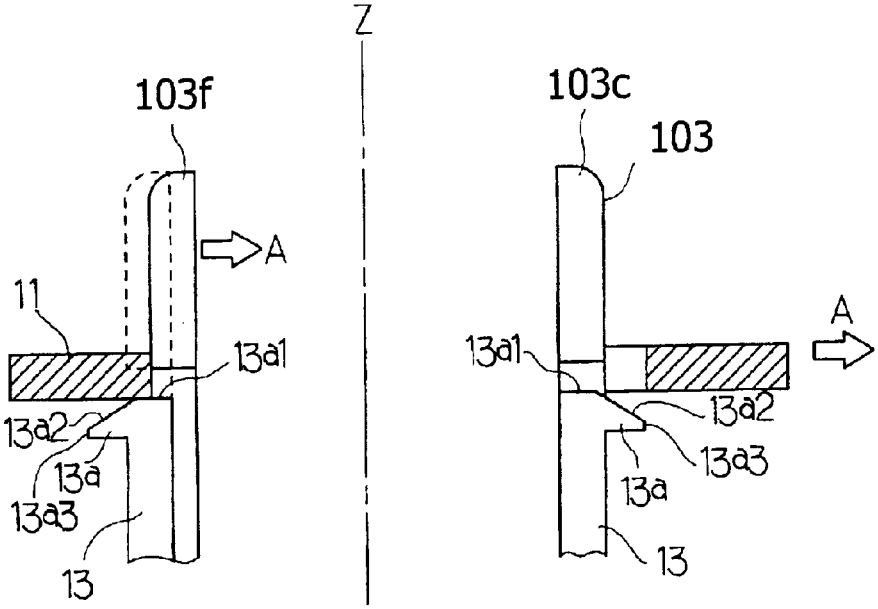
Fig. 11 Prior Art
FIG. 11 is a cross-sectional view of a deflection yoke for explaining the prior art.

In addition, as the clamp band 5 does not contact the protrusions 33*a*0, 33*b*0 when the clamp band 5 is tightened up, the slope angle of the slope sides 33*a*2 and 33*b*2 (equivalent to the slope angle θ shown in FIG. 10) can be increased to make the insertion of the magnetic rings 10, 11, 20 and 21 easier.

The present invention is not limited to the embodiment described above and can be modified in various ways. The protrusions 80*a* and 80*b* can be formed in any place as long as the physical relationship between the protrusion 80*a* and 80*b*, and the protrusions 33*a*0 and 33*b*0 in the direction of the Z axis is the same as the first embodiment. However, it is preferable that the position of the protrusions 80*a* and 80*b* are formed contiguous the protrusions 33*a*0 and 33*b*0. The slope sides 80*a*1 and 80*b*1 may not necessarily be flat. They can be curved surface as long as they help the insertion of the magnetic rings 10, 11, 20 and 21 easier. The other sides of the protrusions 80*a* and 80*b* are not necessarily flat that the edge line can be rounded off which is preferable for the purpose of molding the neck portion 3. The number of the protrusions 80*a* and 80*b* is not limited to two which is same as the number of the upper holding portions 33*a* and 33*b* in this embodiment. There can be more than two protrusions 80*a* and 80*b* formed in the neck portion 3.

[Second Embodiment]

Figure 7:
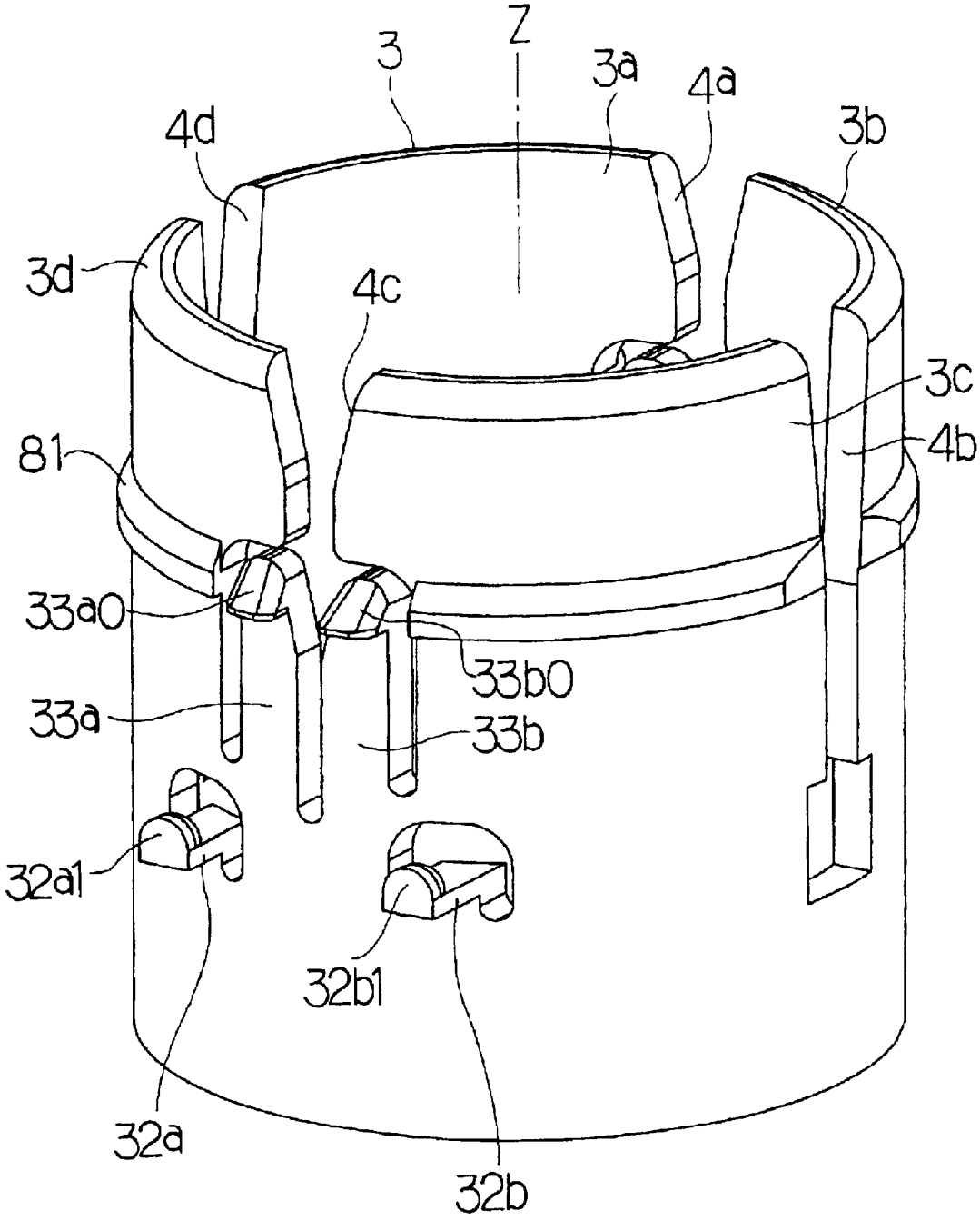
FIG. 7 is a partial perspective view of a substantial portion of a deflection yoke according to a second embodiment of the present invention.
Figure 8:
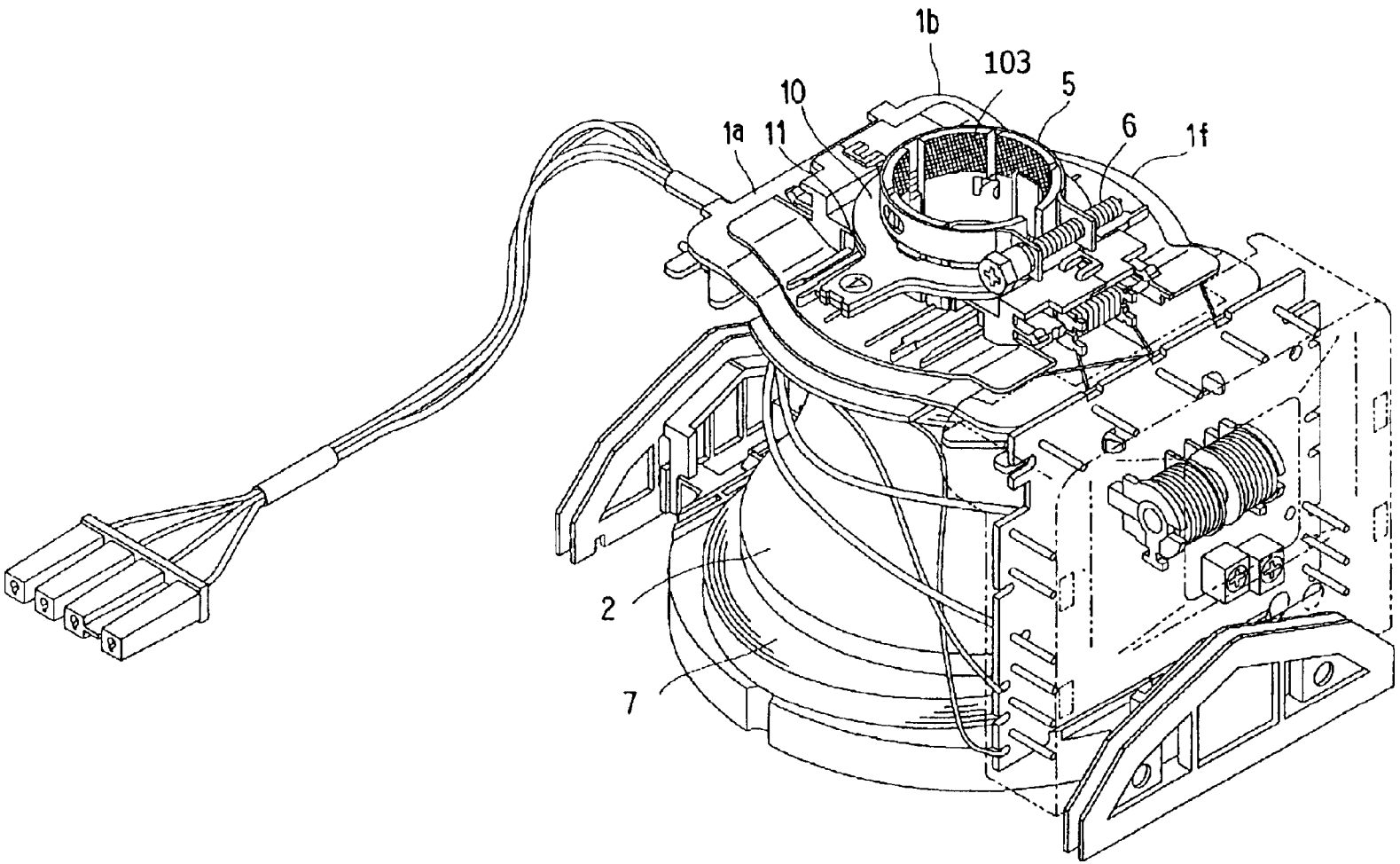
Fig. 8 Prior Art
FIG. 8 is a perspective view of a deflection yoke according to the prior art.

FIG. 7 is a partial perspective view of a substantial portion of a deflection yoke for second embodiment according to the present invention. In FIG. 7, a circular protrusion 81 is formed on the neck portion 3 in the direction of circumference. The circular protrusion 81 is equivalent to the protrusions 80*a* and 80*b* shown in FIG. 3 formed continuously around the neck portion 3. In this sense, the cross-sectional view of the circular protrusion 81 in the direction parallel to the Z axis is the same as the cross-sectional view of the protrusion 80*a* or protrusion 80*b* in the direction parallel to the Z axis. Although it is not shown, the protrusion can also be an arc shape.

The first embodiment above describes that the upper holding portions 33*a* and 33*b*, and the holding portions 32*a* and 32*b* are formed in two pairs in one side of the neck portion 3 but there can be only one pair of the upper holding portion and the holding portion. The magnetic rings 10, 11, 20 and 21 to be inserted on the neck portion 3 are not limited to be four (4) and could be more or less. The present invention is not limited to the above embodiments and can be modified within the scope of the purpose of the present invention.

According to an aspect of the present invention, there provided a deflection yoke having a protrusion on a neck portion of the deflection yoke where such protrusion has a slope surface decline to the outer direction from the narrower diameter side to the wider diameter side of the deflection yoke, and contacts a magnetic ring being inserted to the neck portion from the narrower diameter side before the magnetic ring contacts holding portion, and the magnetic ring is held by the holding portion wherein the magnetic ring contacts a second protrusion and the holding portion, and the second protrusion is formed between a first protrusion to stable a clamp band and the holding portion formed on the neck portion, to easily insert the magnetic ring on the neck portion and to avoid the magnetic ring from being damaged.

What is claimed is:

1. A deflection yoke apparatus comprising:

a neck portion in a cylindrical shape formed on a subterminal portion of a funnel shaped separator having a narrower diameter portion and a wider diameter portion;

a first protrusion formed on said neck portion;

a clamp band having a hole for receiving said first protrusion thereby attaching the clamp band to the neck portion, tightening of the band causing the neck portion to form the narrower diameter portion relative to the wider diameter portion;

at least one magnetic ring rotatably mounted on said wider diameter portion of said neck portion;

a holding portion for holding said magnetic ring on said wider diameter portion; and a second protrusion formed on said neck portion and having a first slope surface declining outwardly from said narrower diameter portion to said wider diameter portion of said neck portion;

wherein said magnetic ring contacts said first slope surface before contacting said holding portion when said magnetic ring is inserted on said neck portion from an outward end of said narrower diameter portion;

wherein said second protrusion guides said magnetic ring to said holding portion;

wherein said holding portion has a second slope surface declining outwardly from said narrower diameter portion to said wider diameter portion of said neck portion; and further wherein said first slope surface of said second protrusion guides said magnetic ring to said second slope surface of said holding portion.

2. The deflection yoke apparatus as claimed in claim 1, wherein said second protrusion is formed on said neck portion between said first protrusion and said holding portion.

* * * * *